United States Patent [19]

Hautemont

[11] Patent Number: 4,503,656

[45] Date of Patent: Mar. 12, 1985

[54] INITIAL STERILIZATION OF STERILE CHAMBER OF ASCEPTIC PACKAGING MACHINE

[75] Inventor: Jean-Claude H. Hautemont, Gif-sur-Yvette, France

[73] Assignee: Societe Anonyme dite: Etude et Realisation de Chaines Automatiques ERCA, Orsay, France

[21] Appl. No.: 441,304

[22] Filed: Nov. 12, 1982

[51] Int. Cl.[3] ..... B65B 55/00

[52] U.S. Cl. ..... 53/396; 53/425; 53/167

[58] Field of Search ..... 53/167, 425, 426, 453, 53/559, 396; 422/25, 40, 302, 304

[56] References Cited

U.S. PATENT DOCUMENTS

| | | | |
|---|---|---|---|
| 3,911,640 | 10/1975 | Rausing | 53/453 X |
| 4,045,943 | 9/1977 | Baumstingl | 53/167 X |
| 4,287,702 | 9/1981 | Corbic | 53/425 |

FOREIGN PATENT DOCUMENTS

| | | | |
|---|---|---|---|
| 1188123 | 4/1970 | United Kingdom | 422/25 |

*Primary Examiner*—Robert L. Spruill
*Assistant Examiner*—Richard M. Mudd
*Attorney, Agent, or Firm*—Charles E. Brown

[57] ABSTRACT

This relates to starting up of a machine wherein a thermoformable web forms a bottom of a sterile chamber in the machine and wherein it is necessary to sterilize all of the interior of the machine including forming and filling equipment as well as heating equipment. It has been deemed advisable to use as a sterilizing agent superheated air. However, the temperature of the sterilizing air is above the melt temperature of the thermoformable web which normally forms the bottom closure for the sterile chamber. This problem is solved by providing a setup arrangement wherein the bottom of the sterile chamber is formed by a heat resistant web and wherein the thermoformable base web and an associated closure web are so related to the heat resistant web that once sterilization of the components within the sterile chamber has been achieved sterility may be maintained by the mere introduction of sterile air and the heat resistant web may be fed from the machine while introducing the thermoformable web for machine operation thereon.

9 Claims, 4 Drawing Figures

INITIAL STERILIZATION OF STERILE CHAMBER OF ASCEPTIC PACKAGING MACHINE

It is known to provide a sterile web into a sterile chamber of an asceptic packaging machine with that sterile web being formed of a thermoformable material, customarily a lamination of plastic films or webs, and within the sterile chamber to thermoform the web to form plural interconnected containers, then to fill the containers with a sterile product, followed by closing and sealing of the filled containers. In certain of such machines, the sterile chamber is defined by an elongated tunnel which is constructed without a bottom and wherein the thermoformable web forms such sterile chamber bottom.

When a sterilizing liquid is utilized to effect sterilization, no start-up problem is involved. On the other hand, when the sterility of the sterile chamber is maintained after start-up utilizing a sterile gas, including air, special steps must be taken to effect sterilization of the equipment which is within the confines of the tunnel.

Inasmuch as the bottom of the sterile chamber is formed during the operation of the machine by the web from which the containers are formed and since this web is formed of a thermoformable material, preferably plastic material, there are limits as to the temperature which may be employed to heat all of the machinery components within the sterile chamber to a temperature wherein the exposed surfaces become sterile. In order that the start-up may be rapidly effected, the initial sterilization of the equipment within the chamber is desirably effected utilizing a gas, preferably air, heated to a very high temperature, i.e. one at which the normal thermoformable web will either melt or become distorted to the extent that it cannot maintain a seal with the side edges of the tunnel.

This invention relates to a start-up setup wherein during the initial sterilization of the equipment within the sterile chamber high temperatures may be employed without damage to the thermoformable web, but wherein, as soon as the heating of the equipment to the extent required for sterilization has been effected, start-up of the machine with substantially no thermoformable web loss is possible.

In accordance with this invention, the bottom of the chamber is initially closed by a stationary heat resistant web and the thermoformable web may have a lead end directed into an entrance into the sterile chamber and secured to a trailing end of the heat resistant web so that, as soon as operating conditions exist within the sterile chamber, feeding of the web through the machine may be effected with the heat resistant web led out of the machine and carrying with it the thermoformable web for the normal operation of the machine.

The thermoformable web is beneficially provided with a sterile container forming surface which is protected against contamination by a peelable cover web. The peelable cover web may completely overlie and protect the thermoformable web at the start-up condition, with the cover web having a leading portion thereof reversely extending out through the entrance opening and ready for removal upon start-up of the machine.

The thermoformable web and cover webs may be protected during the high temperature sterilization conditions by a removable isolating sheet.

Machines of the type to which this invention relates also normally provide a closure web which is introduced into the sterile chamber adjacent the discharge therefrom. A lead-in of the closure web may overlie a leading end portion of the heat resistant web and exit from the machine therewith ready for machine operation. The closure may also have a sterile face which is protected by a cover web with a leading portion of the cover web maintaining sterility of most of the closure web face and exiting through the same opening into which the laminated closure web and cover web enter into the sterile chamber. Further, a temporary isolating sheet may be positioned to protect the closure web and its associated cover web.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
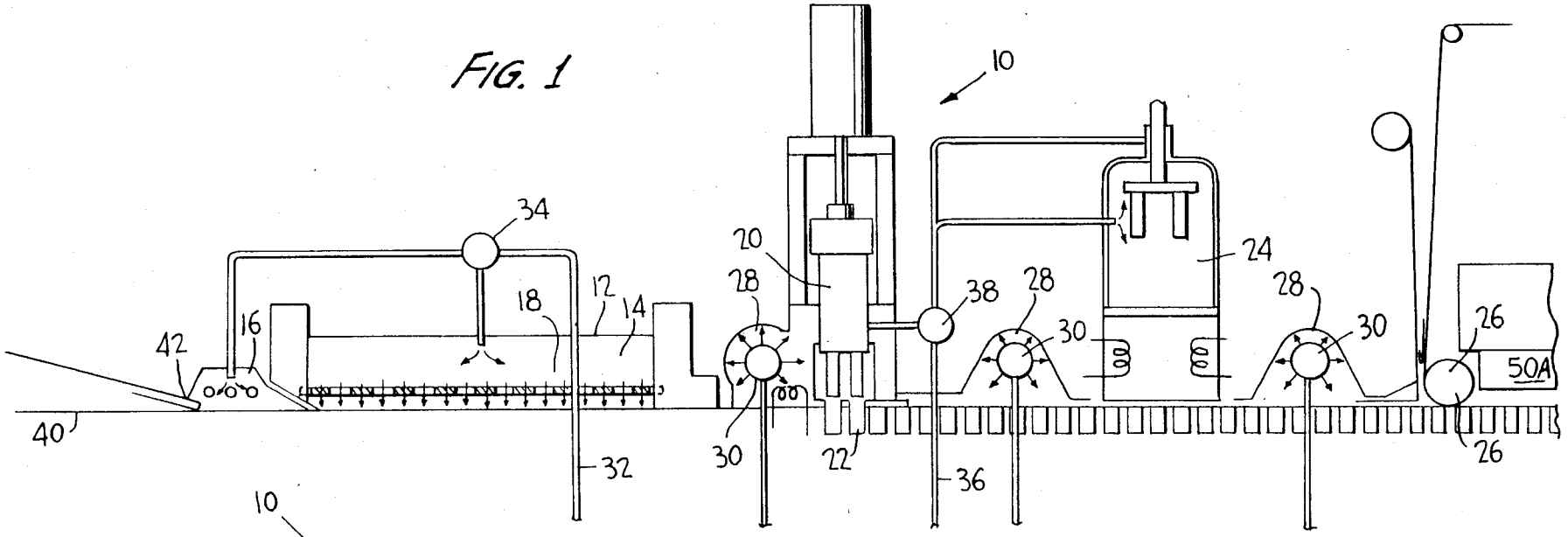
FIG. 1 is a schematic longitudinal vertical sectional view through the machine, showing the various webs in place.

Referring now to the drawings in detail, reference is first made to FIG. 1 wherein the general details of the machine to which this invention is applicable are illustrated. The machine, which is identified by the numeral 10, includes an elongated tunnel 12 which defines a sterile chamber 14. The specifics of the interior mechanisms of the machine 10 are not material here and will be described only in general terms. Within the sterile chamber 14 starting at the entrance end thereof is an initial heating section 16 followed by a heating section 18 which is utilized to heat the thermoformable web (to be described hereinafter) to a thermoforming temperature. The heated thermoformable web is then passed into a forming section 20 wherein the web is formed to define a plurality of upwardly opening containers 22 which are normally arranged in transverse rows and longitudinal columns.

Downstream of the forming section 20 there is a filler 24 which functions to fill the containers 22 with the product which is to be packaged.

At the exit end of the tunnel 12, the tunnel is closed by a roll 26.

Within the tunnel 12 is a plurality of sterile air supply sections 28 for supplying sterile air through filters 30 for the purpose of maintaining the sterility of the sterile chamber 14 during the normal operation of the machine 10. There are other separate air supplies including an air supply line 32 which delivers sterile air through a filter 34 into the sections 16 and 18. There is also a supply line 36 which delivers sterile air through a filter 38 into the forming equipment and into the filling equipment.

Figure 2:
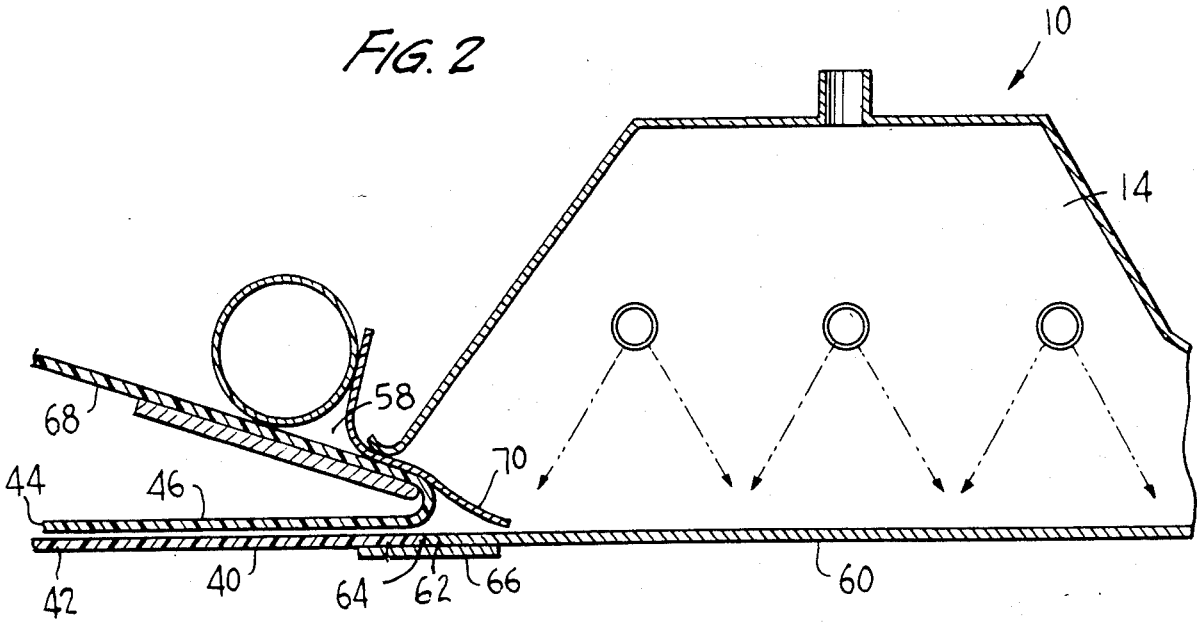
FIG. 2 is an enlarged schematic sectional view through the entrance end of the machine, and shows the specific relationship of the base thermoformable web, its cover web, and the temperature resistant web.

In the normal operation of the machine 10, a thermoplastic web 40 is delivered into the entrance end of the sterile chamber 14 through an entrance opening 42. As is best shown in FIG. 2, the thermoformable web is in the form of a base web which is a lamination of two or more webs or films. The base web 40 may include such webs or films as a polystyrene film 42 and a polyethylene facing film 44. The base thermoformable film 40 is provided with a removable cover film 46 which is peelable therefrom and overlies the polyethylene film 44. The cover film or web 46 is peelable from the polyethylene film 44 and the opposed faces of these two films or webs are sterile when the laminate formed from the base web 40 and the cover web 46 are delivered to the machine 10.

The base web 40 with the cover web 46 removed therefrom passes entirely through the machine 10 and exits beneath the roll 26. As previously described, the base film 40 is thermoformed to provide a plurality of interconnected, open mouth depending containers 22.

Figure 3:
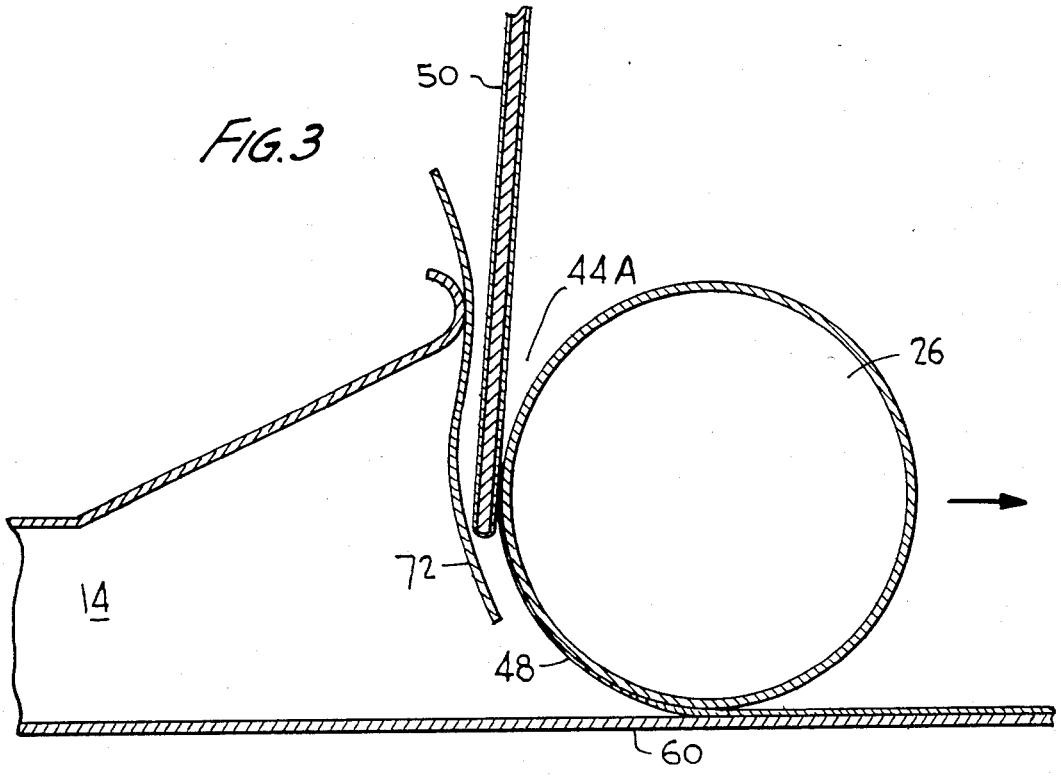
FIG. 3 is an enlarged fragmentary schematic sectional view through the exit end of the machine, and shows the specific relationship of the heat resistant web, the closure web and its associated cover web.

At the exit end of the machine 10, as is best shown in FIG. 3, there is introduced a closure web 48 which, during the normal operation of the machine 10, will supply the base web 40 having the containers 22 formed therein and with the containers being filled with the product to be packaged. Externally of the sterile chamber 14, the closure web 48 is sealed or bonded to the base web 40 at a sealing station 50A (FIG. 1).

The closure web 48 passes into the sterile chamber 14 through a narrow entrance opening 44A and passes around the roll 26 as is clearly shown in FIG. 3. The closure web 48 has a sterile face which opposes the sterile face of the base web 40 and is bonded thereto. The closure web 48 may also be of a laminated construction and may include an aluminum foil base and a polyethylene face film. In order to maintain the sterility of the closure web 48, it is also provided with a peelable cover web 50 which is preferably formed of polypropylene and is peeled therefrom within the sterile chamber and returns therefrom through the entrance opening 44A.

Figure 4:
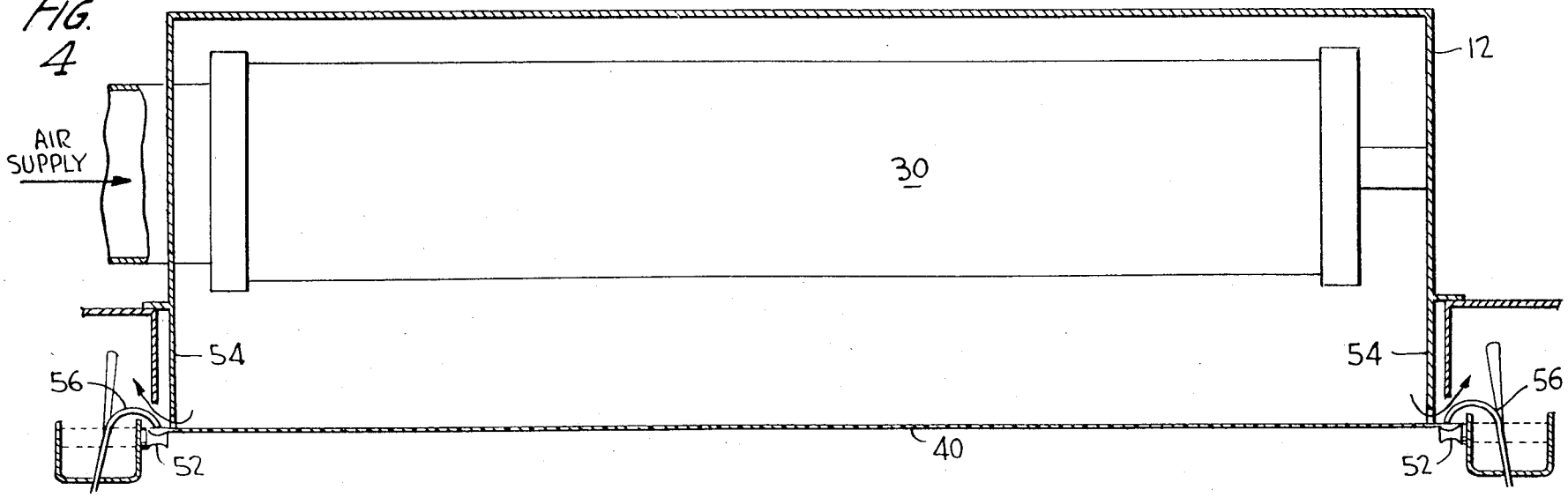
FIG. 4 is a transverse sectional view taken through the sterile chamber, and shows the manner in which the bottom forming web is sealed relative to the tunnel.

Referring now to FIG. 4, it will be seen that in the normal operation of the machine 10 the side edges of the base web 40 are carried by chains 52 beneath lower edges of side walls 54 of the tunnel 12 and also beneath retaining fingers 56.

It is to be understood that sterile air, which is delivered into the sterile chamber 14, is supplied under greater than atmospheric pressure and that there is a constant leakage of the sterile air out through the entrance opening 58 for the web 40, the entrance opening 44 for the closure web 48 and beneath the lower edges of the side walls 54 of the tunnel 12, as shown in FIG. 4.

It is to be understood that there is considerable equipment within the sterile chamber 14, including the walls of the tunnel 12, which must be in a sterile state and cannot be placed in that sterile state by the mere introduction of sterile air. Accordingly, at start-up it is necessary to supply the machine with a much more highly heated air at a sterilization temperature which is above the melting temperature of the thermoformable base web 40. Therefore, unless the entire interior of the sterile chamber 14 has a sterilization fluid, such as hydrogen peroxide, applied thereto, means must be provided for maintaining the seal of the sterilization chamber. In accordance with this invention, at the initial start-up setup of the machine, in lieu of the thermoformable base web 40 forming the bottom of the sterile chamber as occurs during normal operating conditions, the bottom of the sterile chamber has been formed by a heat resistant web 60. As is shown in FIG. 2, the heat resistant web 60 has its trailing end at the entrance opening 58 and, as shown in FIG. 3, the heat resistant web 60 extends beneath the roll 26 and out of the machine 10.

Referring once again to FIG. 2, it will be seen that the web 60, which may be in the form of a web of aluminum foil, has a trailing end 62 connected to a lead end 64 of the thermoformable web 40 in abutting relation with the connection being by way of a joint forming strip 66 which is adhesively bonded to the underside of both webs 40 and 60.

It is to be noted that the position of the lead end 64 is such that substantially the entire sterile face of the web 40 remains covered by the cover film 46. It is also to be noted that the cover web 46 has a lead end portion 68 which extends beyond the lead end 64 of the web 40 and is reversely turned and extends out of the sterile chamber 14. Thus, the sterile face of the base web 40 is in a protected sterile condition ready for use.

Referring to FIG. 3, it will be seen that the closure web 48 extends into the machine around the lower portion of the roll 26 in the normal manner and overlies the web 60 for discharge from the machine therewith. The sterility of the face of the closure web 48, except for the small segment of the web 48 which leads from the sterile chamber 14, is protected in the normal manner by the cover web 50 which is reversely turned and leads out of the sterile chamber 14.

The necessary superheated air may be directed into the sterile chamber 14 through the same supply lines as the customary sterile air. This highly heated equipment sterilizing air will not harm the heat resistant web 60 and thus portions of the webs 40 and 46 which are, in effect, within the sterile chamber 14 at the entrance 58 are protected by an isolating sheet 70. This sheet may be formed of a suitable heat resistant material which does not transfer heat. For example, Teflon has been found to be a satisfactory material. The sheet 70 is readily introduced into the entrance opening 58 and then removed an instant before or shortly after the machine start-up is initiated.

Although only a preferred embodiment of the invention has been specifically illustrated and described herein, it is to be understood that minor variations may be made in the invention without departing from the spirit and scope of the invention as defined by the appended claims.

I claim:

1. A sterilizing start-up setup for an asceptic forming, filling and closing apparatus of the type including an elongated internally sterile chamber initially having an open bottom with said bottom being formed during operation of said apparatus by a thermoformable base web from which containers are formed, said setup including a thermoformable base web starting end at one end of said chamber, a heat resistant web trailing end secured to said thermoformable base web starting end and extending the full length of said chamber and beyond, said heat resistant web forming a temporary base web having a peelable cover web, said cover web extending beyond said thermoformable base web and reversely out of said chamber, and means for supplying a gas at a sterilizing temperature above the softening temperature of said thermoformable base web into said chamber for heating and thus sterilizing all exposed components of said apparatus within said chamber.

2. A sterilizing start-up setup according to claim 1 wherein there is a removable isolating sheet extending into said chamber in overlying protective relation to said cover web.

3. A sterilizing start-up setup according to claim 1 wherein there is an entrance opening into said chamber for a closure web, a closure web having a removable cover web extending into said chamber through said entrance opening and exits from said chamber in overlying relation to said heat resistant web, and said cover web for said closure web being reversely turned and exiting from said chamber.

4. A sterilizing start-up setup according to claim 3 wherein there is a removable isolating sheet extending into said chamber in overlying protective relation to each of said cover webs.

5. A sterilizing start-up setup according to claim 1 wherein said heat resistant web is formed of metal foil.

6. A method of starting up an apparatus for asceptic packaging of a product which includes a sterile chamber containing package forming and filling equipment and wherein a bottom wall of said chamber is normally formed by a base web of thermoformable material, said method comprising the steps of temporarily forming the bottom wall of said chamber with a heat resistant web, securing a leading end of a thermoformable base web to a trailing end of the heat resistant web within a beginning part of the sterile chamber, the base web having a sterile face covered by a cover web peelable therefrom, providing a portion of the cover web extending beyond the base web leading end and reversely turning the cover web extending portion and directing the same back out of the sterile chamber, and initially sterilizing the interior of the sterile chamber and the package forming and filling equipment therein by introducing into the chamber for a period of time a gas heated to a sterilizing temperature which is above the melting temperature of the base web.

7. A method according to claim 6 wherein a temporary isolating sheet is placed in the chamber in overlying protective relation to the cover web.

8. A method according to claim 6 wherein a closure web and an associated cover web are introduced into the chamber adjacent an exit end thereof, the closure web is separated from the associated cover web and directed with the heat resistance web from the chamber while the cover web for the closure web is reversely directed out of the chamber.

9. A method according to claim 8 wherein a temporary isolating sheet is placed in the chamber in overlying protective relation to each of the cover webs.

* * * * *